US010335630B2

(12) United States Patent
Buniak

(10) Patent No.: US 10,335,630 B2
(45) Date of Patent: Jul. 2, 2019

(54) EXERCISE ACCESSORY

(71) Applicant: Scott Buniak, Clifton Park, NY (US)

(72) Inventor: Scott Buniak, Clifton Park, NY (US)

(73) Assignee: Scott Buniak, Clifton Park, NY (US)

( * ) Notice: Subject to any disclaimer, the term of this patent is extended or adjusted under 35 U.S.C. 154(b) by 211 days.

(21) Appl. No.: 15/254,717

(22) Filed: Sep. 1, 2016

(65) Prior Publication Data

US 2018/0056112 A1 Mar. 1, 2018

Related U.S. Application Data

(60) Provisional application No. 62/257,550, filed on Nov. 19, 2015.

(51) Int. Cl.
*A41D 13/00* (2006.01)
*A63B 21/00* (2006.01)

(52) U.S. Cl.
CPC ..... *A63B 21/4035* (2015.10); *A41D 13/00* (2013.01); *A63B 21/4039* (2015.10)

(58) Field of Classification Search
CPC . A47G 9/06; A47G 9/066; A47G 9/04; A47K 10/02; A47K 10/025; A47K 7/022; A47K 7/02; A47K 10/04; A47K 10/12; A47K 10/16; A47K 2010/322; A47K 3/062; A47K 3/28; A47K 3/286; A47K 7/04; A63B 21/4035; A63B 21/072; A63B 21/4034; A63B 21/00069; A63B 2225/09; A63B 21/0552; A63B 21/4043
USPC ..... 482/139; 270/32–51; 221/48; 493/430
See application file for complete search history.

(56) References Cited

U.S. PATENT DOCUMENTS 3,857,116 A * 12/1974 Meeker ..... A41B 13/10 2/50
5,150,707 A * 9/1992 Anderson ..... A61F 7/02 604/368
5,203,390 A * 4/1993 Eckstein ..... A63B 53/14 150/160
5,441,789 A * 8/1995 Walker ..... A47C 1/143 297/223
5,491,843 A * 2/1996 Naughton ..... A41D 13/05 2/48
5,615,769 A * 4/1997 Stephenson ..... A45C 15/00 206/315.9
5,724,698 A * 3/1998 Mondragon ..... A47K 10/02 15/209.1
5,817,379 A * 10/1998 Rich ..... A47K 10/02 428/35.2
6,090,467 A * 7/2000 Yip ..... B65H 45/24 221/48
6,182,874 B1 * 2/2001 Feldman, Jr. ..... A45C 13/30 224/259

(Continued)

*Primary Examiner* — Andrew S Lo

(57) ABSTRACT

The present invention provides an exercise accessory which advantageously provides an athlete with a secure and hygienic grip on exercise equipment during training. The exercise accessory includes (a) a moisture absorbent or moisture wicking fabric having opposing ends; and (b) a reinforcing member arrayed along a length of the fabric and coupled to the fabric. The moisture absorbent or moisture wicking fabric is configured to envelop at least a portion of the reinforcing member. The reinforcing member defines one or more loops configured to be operably coupled to an exerciser via an attachment accessory such as a carabiner.

14 Claims, 17 Drawing Sheets

(56) References Cited

U.S. PATENT DOCUMENTS 6,220,997 B1 * 4/2001 Kohl ..... A63B 71/08 128/842
6,227,742 B1 * 5/2001 Corn ..... A47K 7/022 15/208
6,849,055 B1 * 2/2005 Williams ..... A47K 7/022 15/208
D512,259 S * 12/2005 Mitchell ..... D6/608
8,083,652 B2 * 12/2011 Brody ..... A63B 21/0004 482/121
9,486,663 B2 * 11/2016 DeMarco ..... A63B 21/068
9,592,418 B2 * 3/2017 Burrell ..... A61F 5/026
9,724,554 B2 * 8/2017 Burkinshaw ..... A63B 21/068
9,867,409 B1 * 1/2018 Mroz ..... A41D 15/04
9,936,751 B1 * 4/2018 Mignone ..... A41D 31/0011
2001/0034890 A1 * 11/2001 Levas ..... A41D 13/04 2/48
2003/0005535 A1 * 1/2003 Hale ..... A47K 7/02 15/209.1
2004/0127339 A1 * 7/2004 Finn ..... A63B 21/00181 482/140
2004/0211019 A1 * 10/2004 Hale ..... A47K 7/02 15/209.1
2004/0266546 A1 * 12/2004 Huang ..... A63B 49/08 473/300
2005/0107223 A1 * 5/2005 Finn ..... A63B 21/072 482/91
2005/0204501 A1 * 9/2005 Golec ..... A47K 10/02 15/209.1
2005/0239604 A1 * 10/2005 Denham ..... A45F 4/00 482/23
2005/0271857 A1 * 12/2005 Brody ..... A63B 21/0004 428/78
2006/0005335 A1 * 1/2006 Ortega ..... A47K 10/02 15/118
2006/0090237 A1 * 5/2006 Dabney ..... A41D 13/04 2/48
2007/0094826 A1 * 5/2007 Chandler ..... A63B 57/60 15/209.1
2007/0119013 A1 * 5/2007 Abreu ..... A63B 47/001 15/209.1
2007/0226934 A1 * 10/2007 Bohannon ..... A45F 5/04 15/209.1
2008/0101848 A1 * 5/2008 Shaw ..... A63B 57/60 401/200
2008/0115250 A1 * 5/2008 Tousant ..... A41D 7/00 2/69
2008/0164713 A1 * 7/2008 Saurman ..... B60R 11/00 296/77.1
2009/0151105 A1 * 6/2009 Bohannon ..... A45F 5/04 15/210.1
2010/0178821 A1 * 7/2010 Morris ..... A47K 10/02 442/1
2012/0137431 A1 * 6/2012 Pittman ..... A47G 9/062 5/417
2012/0151649 A1 * 6/2012 Peterson ..... A41D 13/0053 2/69
2012/0204900 A1 * 8/2012 Mckenzie ..... A47K 10/02 134/6
2012/0210517 A1 * 8/2012 Patel ..... A47G 9/062 8/137
2013/0037248 A1 * 2/2013 Ackroyd ..... D03D 15/00 165/185
2013/0125307 A1 * 5/2013 Margalit ..... A47G 9/062 5/417
2013/0323457 A1 * 12/2013 Barringer ..... A47K 10/02 428/99
2014/0051557 A1 * 2/2014 Befeld ..... A63B 21/0552 482/130
2014/0366240 A1 * 12/2014 Roban ..... A41D 3/08 2/84
2014/0371039 A1 * 12/2014 Burrell ..... A61F 5/026 482/124
2015/0041603 A1 * 2/2015 Kinder ..... A47K 10/025 248/214
2015/0113699 A1 * 4/2015 Geronimo ..... A42B 1/048 2/84
2015/0173569 A1 * 6/2015 Griggs ..... A47K 7/02 601/46
2015/0182776 A1 * 7/2015 Lewen ..... A63B 7/02 482/24
2015/0297937 A1 * 10/2015 Burkinshaw ..... A63B 21/068 482/124
2016/0045809 A1 * 2/2016 Jones ..... A63B 71/0054 428/100
2016/0135518 A1 * 5/2016 Scott ..... A41D 7/008 2/69
2016/0145786 A1 * 5/2016 Kinder ..... A47K 10/025 112/475.08
2016/0353942 A1 * 12/2016 Barringer ..... A47K 10/02
2016/0375650 A1 * 12/2016 Goecke ..... B32B 5/06 383/4
2017/0056735 A1 * 3/2017 Nevin ..... A63B 57/60
2017/0216708 A1 * 8/2017 Sapp ..... A63B 71/1291
2017/0273515 A1 * 9/2017 Oladeji ..... A47L 13/18

* cited by examiner

EXERCISE ACCESSORY

CROSS REFERENCE TO RELATED APPLICATIONS

This application claims the benefit of U.S. Provisional Application No. 62/257,550, entitled "Exercise Accessory", filed Nov. 19, 2015, and which is incorporated herein by reference in its entirety.

BACKGROUND

The present invention relates to exercise accessories useful in settings wherein resistance-based exercise machines are used by athletes. In particular, this invention deals with exercise accessories which provide for a secure and slip-free link between an athlete and an exercise machine.

Various exercise accessories are known in the art for use in isometric training regimens in which an athlete grips the exercise accessory and applies counterbalancing forces at two or more positions along the exercise accessory in order to develop one or more of the athlete's muscle groups. For example, United States Patent Application 2005/0107223 A1 discloses a multi-function fitness device comprising a fabric strip equipped with pockets at its ends and into which a grip enhancing component may be inserted for the purpose of preventing an athlete's hands from slipping outwardly during an isometric exercise routine.

In non-isometric exercise routines in which an exercise machine provides the resistance to movement necessary to effectively exercise one or more of an athlete's muscle groups, there is frequently direct contact between the athlete's hand (or hands) and a complementary grip structure on the machine. Such structures are prone to accumulate sweat, oil, skin, blood and bacteria during use and may, even when clean and dry at the beginning of an athlete's exercise routine, become slippery and difficult to grasp over the course of the routine, creating conditions favoring premature ending of the exercise routine, or worse, sudden loss of contact with machine grip and subsequent injury to the athlete.

The present invention addresses many of these issues by providing a simple exercise accessory which provides for a secure and slip-free link between an athlete and the exercise equipment. In addition, the exercise accessory provided by the present invention may be used to limit direct contact between the athlete and a complementary structure of the exercise machine.

BRIEF DESCRIPTION

In one embodiment, the present invention provides an exercise accessory comprising: (a) a moisture absorbent fabric having opposing ends; and (b) a reinforcing member arrayed along a length of the fabric and coupled to the fabric; wherein the moisture absorbent fabric is configured to envelop at least a portion of the reinforcing member, and wherein the reinforcing member defines one or more loops configured to be operably coupled to an exerciser via an attachment accessory.

In an alternate embodiment, the present invention provides an exercise accessory comprising: (a) a moisture wicking fabric having opposing ends; and (b) a reinforcing member arrayed along a length of the fabric and coupled to the fabric; wherein the moisture wicking fabric is configured to envelop at least a portion of the reinforcing member, and wherein the reinforcing member defines one or more loops configured to be operably coupled to an exerciser via an attachment accessory.

In yet another embodiment, the present invention provides an exercise accessory comprising: (a) a terry-cloth fabric configured as a towel having opposing ends; and (b) a nylon reinforcing strap arrayed along a longitudinal axis of the fabric and coupled to the fabric with nylon stitches; wherein the fabric is configured to substantially envelop the reinforcing member arrayed along the longitudinal axis of the fabric, and wherein the reinforcing member defines two loops configured to be operably coupled to an exerciser via an attachment accessory.

In still yet another embodiment, the present invention provides an exercise accessory comprising: (a) a moisture wicking fabric configured as a towel having opposing ends; and (b) a nylon reinforcing strap arrayed along a longitudinal axis of the fabric and coupled to the fabric with nylon stitches; wherein the fabric is configured to substantially envelop the reinforcing member arrayed along the longitudinal axis of the fabric, and wherein the reinforcing member defines two loops configured to be operably coupled to an exerciser via an attachment accessory.

In another embodiment, the present invention provides a method of making an exercise accessory comprising: (a) coupling a moisture absorbent fabric having opposing ends to a reinforcing member arrayed along a length of the fabric; and (b) creating one or more loops in one or more end portions of the reinforcing member; wherein the moisture absorbent fabric is configured to envelop at least a portion of the reinforcing member, and wherein the reinforcing member loops are configured to be operably coupled to an exerciser via an attachment accessory.

In yet another embodiment, the present invention provides a method of making an exercise accessory comprising: (a) coupling a moisture wicking fabric having opposing ends to a reinforcing member arrayed along a length of the fabric; and (b) creating one or more loops in one or more end portions of the reinforcing member; wherein the moisture absorbent fabric is configured to envelop at least a portion of the reinforcing member, and wherein the reinforcing member loops are configured to be operably coupled to an exerciser via an attachment accessory.

BRIEF DESCRIPTION OF THE DRAWING FIGURES

Various features, aspects, and advantages of the present invention will become better understood when the following detailed description is read with reference to the accompanying drawings in which like characters may represent like parts throughout the drawings. Unless otherwise indicated, the drawings provided herein are meant to illustrate key inventive features of the invention. These key inventive features are believed to be applicable in a wide variety of systems comprising one or more embodiments of the invention. As such, the drawings are not meant to include all conventional features known by those of ordinary skill in the art to be required for the practice of the invention.

DETAILED DESCRIPTION

Figure 1:
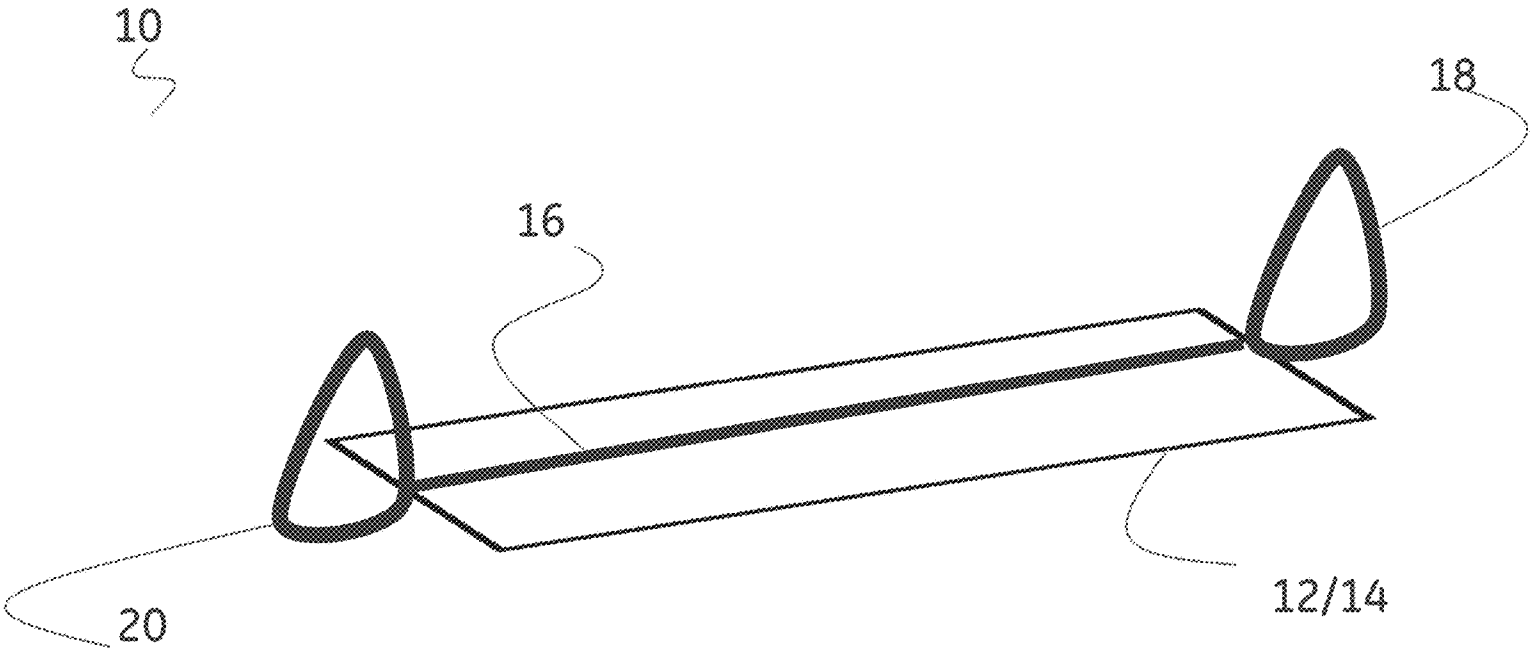
FIG. 1 illustrates an exercise accessory provided by the present invention.

In the following specification and the claims, which follow, reference will be made to a number of terms, which shall be defined to have the following meanings.

The singular forms "a", "an", and "the" include plural referents unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As noted, in one or more embodiments, the present invention provides an exercise accessory comprising a moisture absorbent fabric coupled to a reinforcing member along a length of the fabric. The moisture absorbent fabric and reinforcing member are sized such that the moisture absorbent fabric may be wrapped about the reinforcing member and the combination of the reinforcing member enveloped by the moisture absorbent fabric can be grasped near its midpoint by an athlete making use of the exercise accessory to create a secure and slip free link between the athlete and an exercise machine, at times herein referred to as an exerciser. To establish a secure and slip free link to the exercise machine, the exercise accessory is provided with one or more loops defined by the reinforcing member, and the one or more loops may be operably coupled to an exerciser via an attachment accessory, for example one or more carabiners, straps, hoops, or fasteners. In one or more embodiments, the attachment accessory is a carabiner such as those sold under the brand name Black Diamond. While the use of a variety of exercise machines may be enhanced using the exercise accessory provided by the present invention, the exercise accessory may also be used to enhance an athlete's use of exercise equipment not qualifying as machines, for example, dumbbells, kettlebells, and the like.

Suitable moisture absorbent fabrics include cotton-containing fabrics such as terry cloth, linen, and composite fabrics such those marketed under the brand mane ZORB. In one or more embodiments, the moisture absorbent fabric is a cotton fabric comprising a polymer constituent having a temperature dependent affinity for water. One such polymer constituent is a polymeric coating designated PNIPAAm (poly-N-isopropyl acrylamide). In one or more embodiments, the moisture absorbent fabric comprises a moisture absorbent material selected from the group consisting of cotton, linen, and combinations thereof. In one embodiment, the moisture absorbent fabric is advantageously made of terry cloth.

For simplicity and ease of manufacture, the moisture absorbent fabric may be advantageously configured as a towel having a rectangular shape. In an alternate embodiment, the moisture absorbent fabric may be advantageously configured as a towel having a non-rectangular shape. The moisture absorbent fabric and the reinforcing member may be selected such that the exercise accessory may be laundered under hygienic standards prevailing in state of the art exercise facilities without the need for special laundering. In one or more embodiments, the exercise accessory provided by the present invention may be laundered with towels and other items customarily laundered in such exercise facilities.

Suitable reinforcing members include any suitable material which can be configured as a strap and coupled to the moisture absorbent fabric by some suitable means such as stitching. Various advantages are realized when the reinforcing member is susceptible to being joined to itself at its ends by simple means such as stitching. In one or more embodiments, the reinforcing member is a nylon strap defining loops at either end of the strap which may be used to couple with an exercise machine. Suitable materials which may be may be used in the reinforcing member include various nylons such as nylon 6 and nylon 6,6; aramids and polyesters. Additional suitable materials include natural and synthetic rubbers, silicone polymers and copolyether ester thermoplastic elastomers such as LoMod and Hytrel. In one or more embodiments, the reinforcing member is configured as a woven fabric. In an alternate set of embodiments, the reinforcing member is configured as an extruded strap. The reinforcing member may advantageously include one or more reinforcing components such as steel fibers, carbon fibers, glass fibers and aramid fibers. In one or more embodiments, the reinforcing member comprises one or more of a polymeric material, a composite material, a metal, a metal alloy, and combinations of two or more of the foregoing.

The reinforcing member may be coupled to the moisture absorbent fabric by any suitable means known to those of ordinary skill in the art, such as by one or more of stitching, staples, clamps, adhesives, friction couplings, and combinations of the foregoing. In one or more embodiments the reinforcing member is coupled to the fabric with stitching comprising a polyamide fiber or an elastomeric fiber. In one or more embodiments, the reinforcing member is coupled to the fabric with stitching comprising a nylon fiber. In an alternate set of embodiment, the reinforcing member is coupled to the fabric with stitching comprising a polyester fiber.

As noted, the moisture absorbent fabric is configured to envelop the reinforcing member, meaning that the relative sizes of the moisture absorbent fabric and reinforcing member are such that the moisture absorbent fabric may be wrapped around the reinforcing member. Typically, the length of the moisture absorbent fabric is shorter than that of the reinforcing member so that the ends of the reinforcing member extend beyond the opposing ends of the fabric, and as such the fabric is configured to envelop only a portion of the total length of the reinforcing member. During manufacture, this allows the ends of the reinforcing member to be elaborated into loops by stitching the end of the reinforcing member back upon itself or by providing other means for creating loops in the ends of the reinforcing member such as friction couplings and the like. In an alternate set of embodiments, the moisture absorbent fabric has a length greater than the length of the reinforcing member and is said to be configured to entirely envelop the reinforcing member.

As noted, the reinforcing member defines one or more loops which can be used to operably couple the exercise accessory to an exerciser. In one or more embodiments, the loop (or loops) of the exercise accessory is directly attached to an exerciser. In one or more embodiments, the loop (or loops) of the exercise accessory is attached to the exerciser via an attachment accessory, such as a carabiner. In one or more embodiments, the reinforcing member defines a single loop. In one or more alternate embodiments, the reinforcing member defines a plurality of loops. In one or more embodiments, the reinforcing member defines two and only two loops.

In an alternate set of embodiments, the present invention provides an exercise accessory comprising (a) a moisture wicking fabric having opposing ends; and (b) a reinforcing member arrayed along a length of the fabric and coupled to the fabric; wherein the moisture wicking fabric is configured to envelop at least a portion of the reinforcing member, and wherein the reinforcing member defines one or more loops configured to be operably coupled to an exerciser via an attachment accessory. Suitable moisture wicking fabrics include fabrics comprising one or more of nylon, polypropylene, spandex, rayon, polyester, polyester blends, treated silk, and merino wool. Suitable moisture wicking fabrics include those sold under the trade names Coolmax, Lycra, Dri-Fit, Supplex, Tactel and Meryl, among others. The discussion of FIG. 1-FIG. 17 which follows, emphasizes embodiments comprising either or both moisture absorbent fabrics and moisture wicking fabrics. Those skilled in the art and having read this disclosure will appreciate that any embodiment disclosing an exercise accessory comprising only a moisture absorbent fabric may be recast as an exercise accessory comprising only a moisture wicking fabric.

Turning now to the figures, FIG. 1 illustrates an exercise accessory 10 according to one or more embodiments of the present invention. In the embodiment shown, a moisture absorbent or moisture wicking fabric 12/14 is shown as rectangular in shape and coupled to a reinforcing member 16 along a portion of the length of the reinforcing member and the entire length of the fabric. The reinforcing member defines first and second reinforcing member loops 18 and 20 at opposite ends of the reinforcing member. In the embodiment shown, the moisture absorbent or moisture wicking fabric 12/14 is configured to envelop only that portion of the reinforcing member not defining the first and second loops 18 and 20. In addition, the length of the fabric upon which the reinforcing member is arrayed corresponds to both the longitudinal axis of the fabric and an axis of rotation of the fabric (See also FIG. 15).

Figure 2:
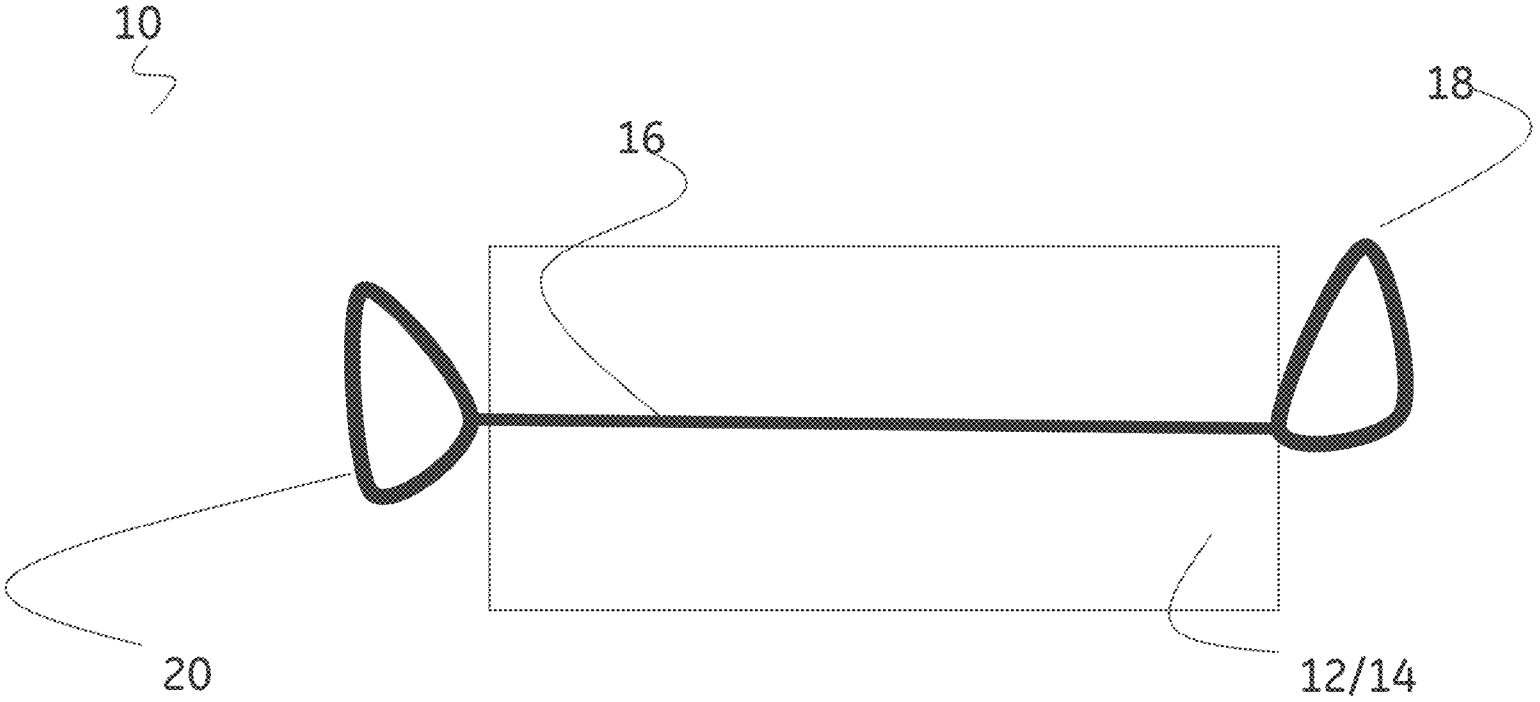
FIG. 2 illustrates an exercise accessory provided by the present invention.

Referring to FIG. 2, the figure represents a top down view of the exercise accessory 10 shown in FIG. 1. As in FIG. 1, the moisture absorbent or moisture wicking fabric 12/14 is shown as rectangular in shape and configured to partially envelop the reinforcing member 16. The exercise accessory is shown as not configured to envelop the first and second loops 18 and 20 defined by the reinforcing member.

Figure 3:
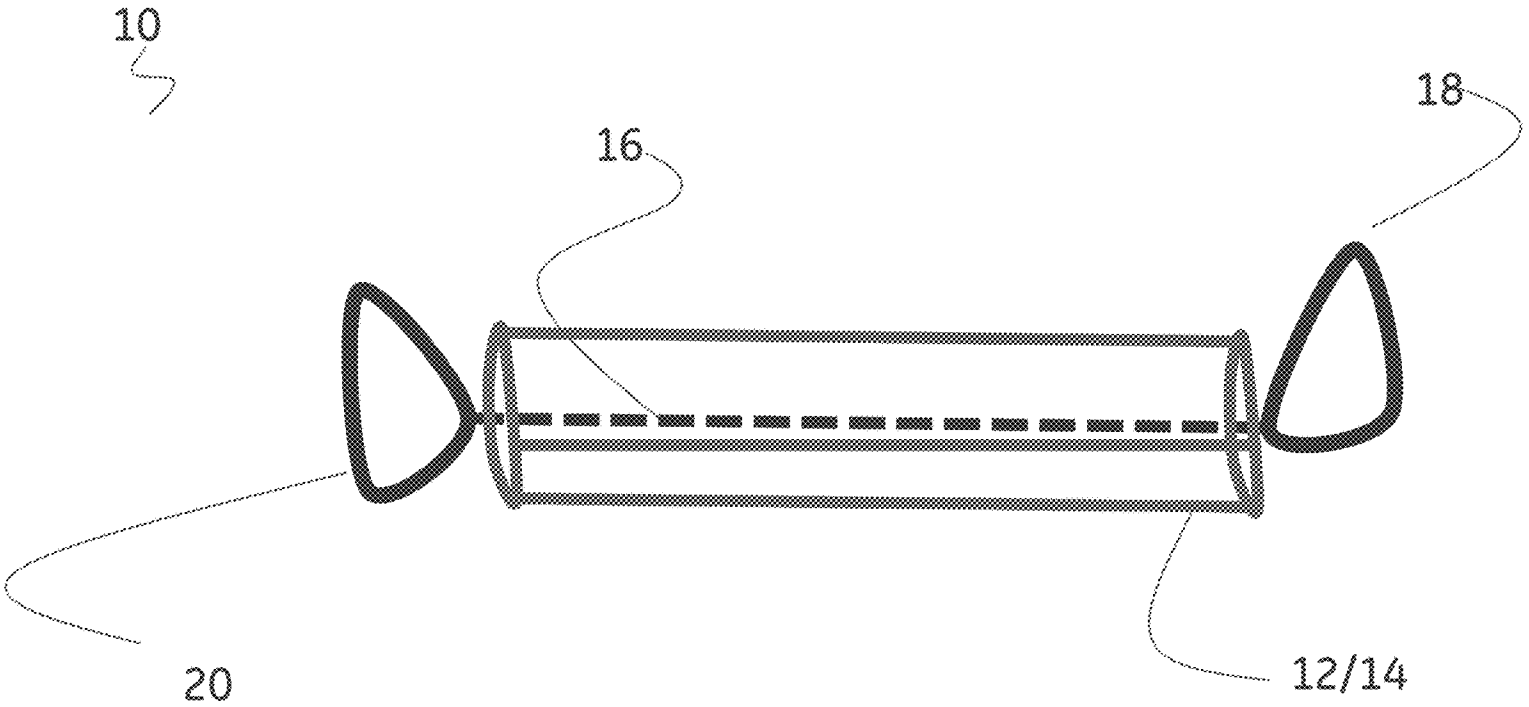
FIG. 3 illustrates an exercise accessory provided by the present invention.

Referring to FIG. 3, the figure represents a side on view of the exercise accessory 10 shown in FIG. 1 following wrapping of the excess moisture absorbent or moisture wicking fabric 12/14 around the mid-portion of the reinforcing member 16.

Figure 4:
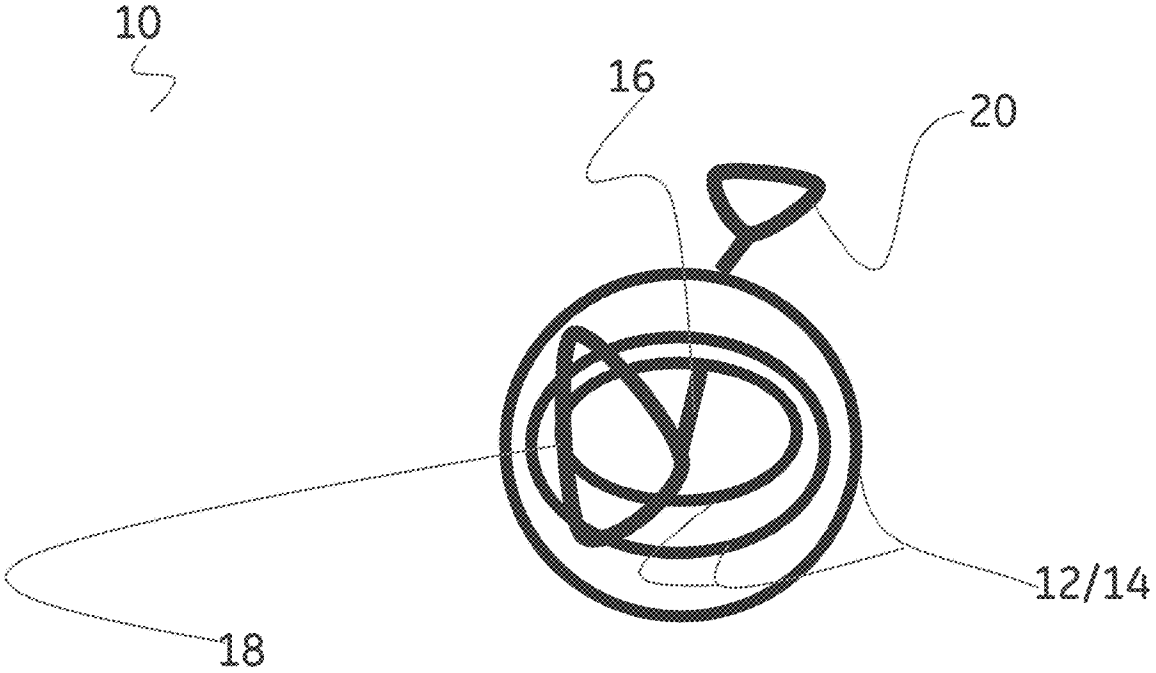
FIG. 4 illustrates an exercise accessory provided by the present invention.

Referring to FIG. 4, the figure represents an end-on view of the exercise accessory 10 shown in FIG. 3.

Figure 5:
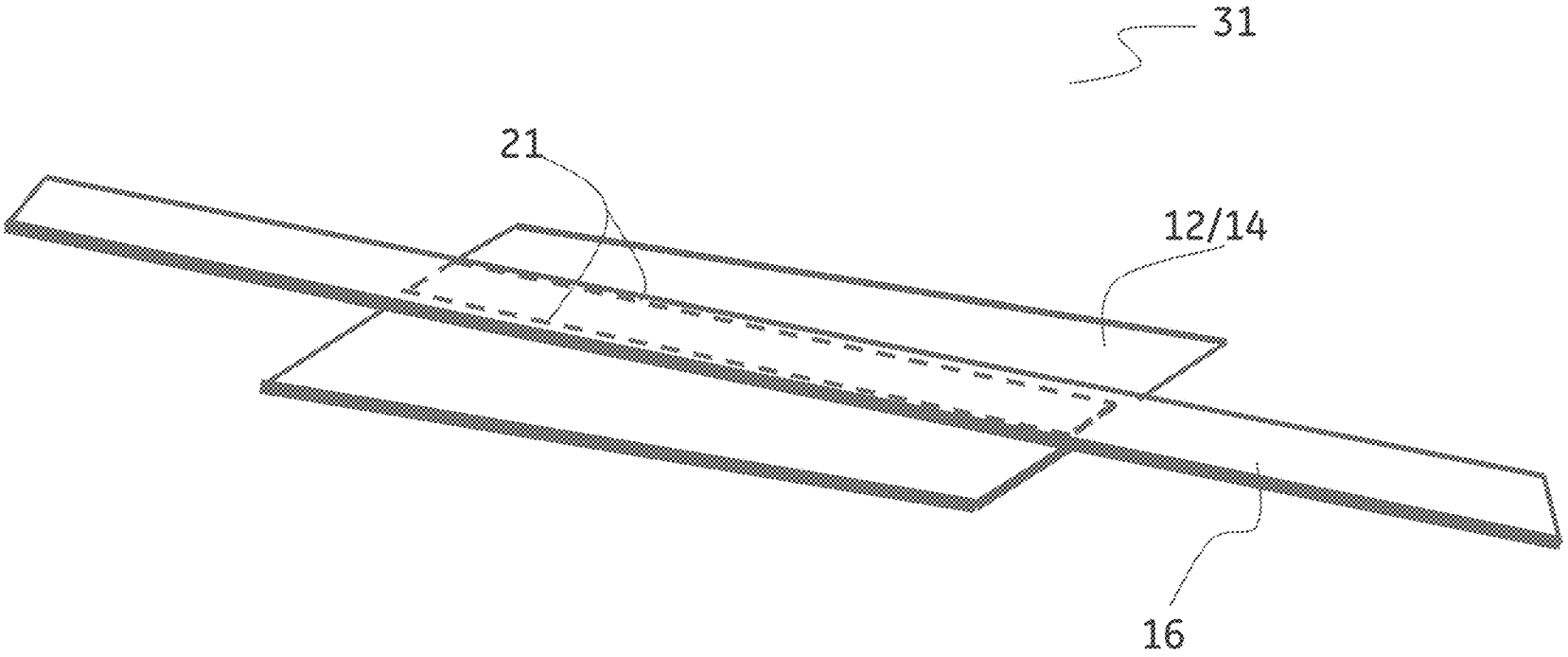
FIG. 5 illustrates a method of making an exercise accessory provided by the present invention.

Referring to FIG. 5, the figure illustrates a method 30 of making an exercise accessory 10 according to one or more embodiments of the present invention. In a first step 31 a reinforcing member 16 is brought into contact with the surface of a moisture absorbent fabric 12 or moisture wicking fabric 14 having opposing ends. The reinforcing member is arrayed along the centerline longitudinal axis of the moisture absorbent fabric. In one or more embodiments illustrated by FIG. 5, the fabric moisture absorbent or moisture wicking fabric 12/14 and is a terry cloth towel. The reinforcing member 16 is coupled to the fabric 12/14 by a first set of stitches 21. The stitches may comprise any high strength fiber, for example a polyamide fiber such as nylon, or a polyester fiber, or an elastomeric fiber. In one or more embodiments, the stitches are configured in any of a variety of hand and/or machine sewing stitches, for example chain stiches, lock stiches, straight stiches, zigzag stitches, overlock stitches, running stiches, back stiches, satin stiches, outline stiches and the like.

Figure 6:
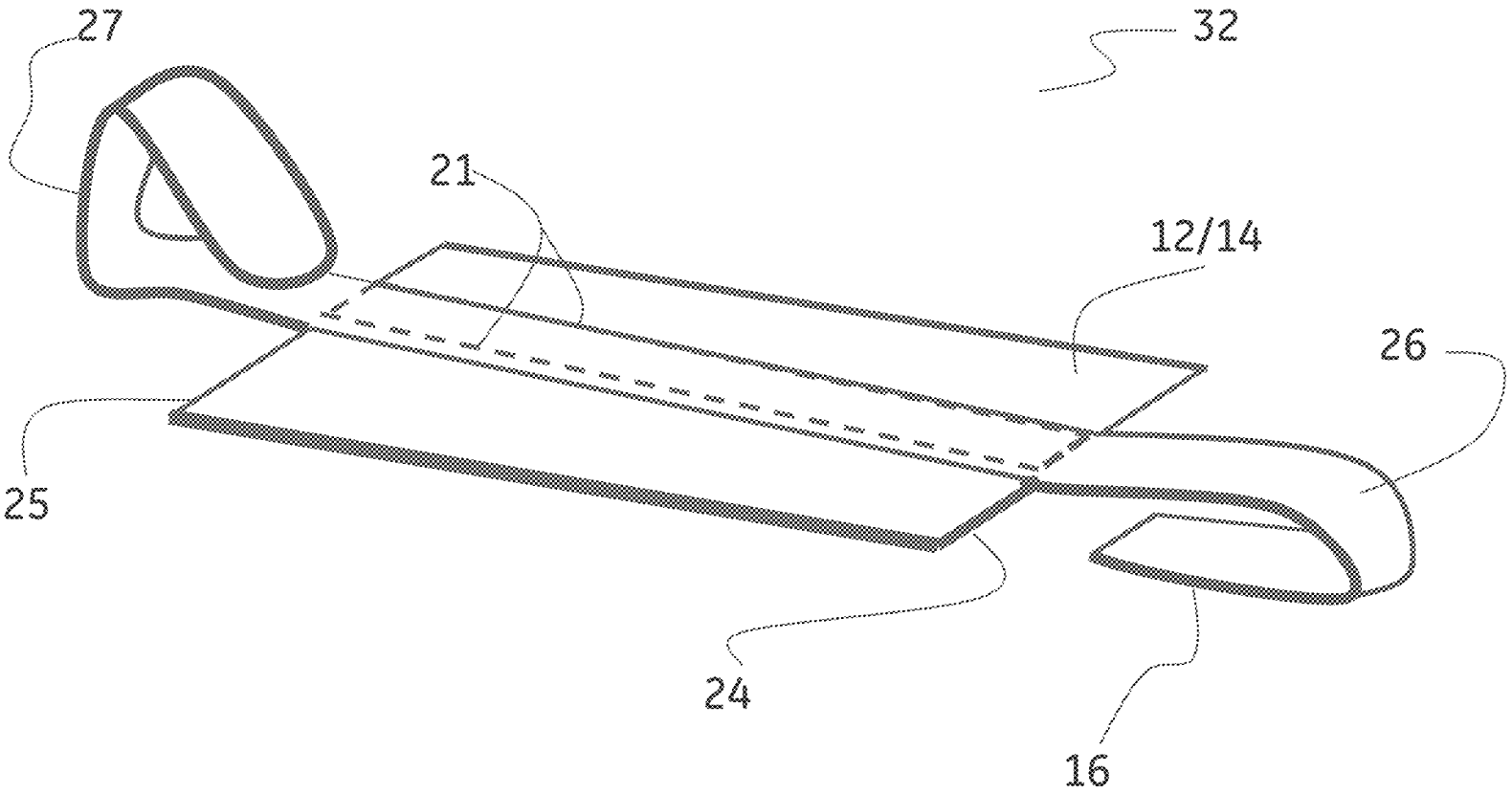
FIG. 6 illustrates a method of making an exercise accessory provided by the present invention.
Figure 7:
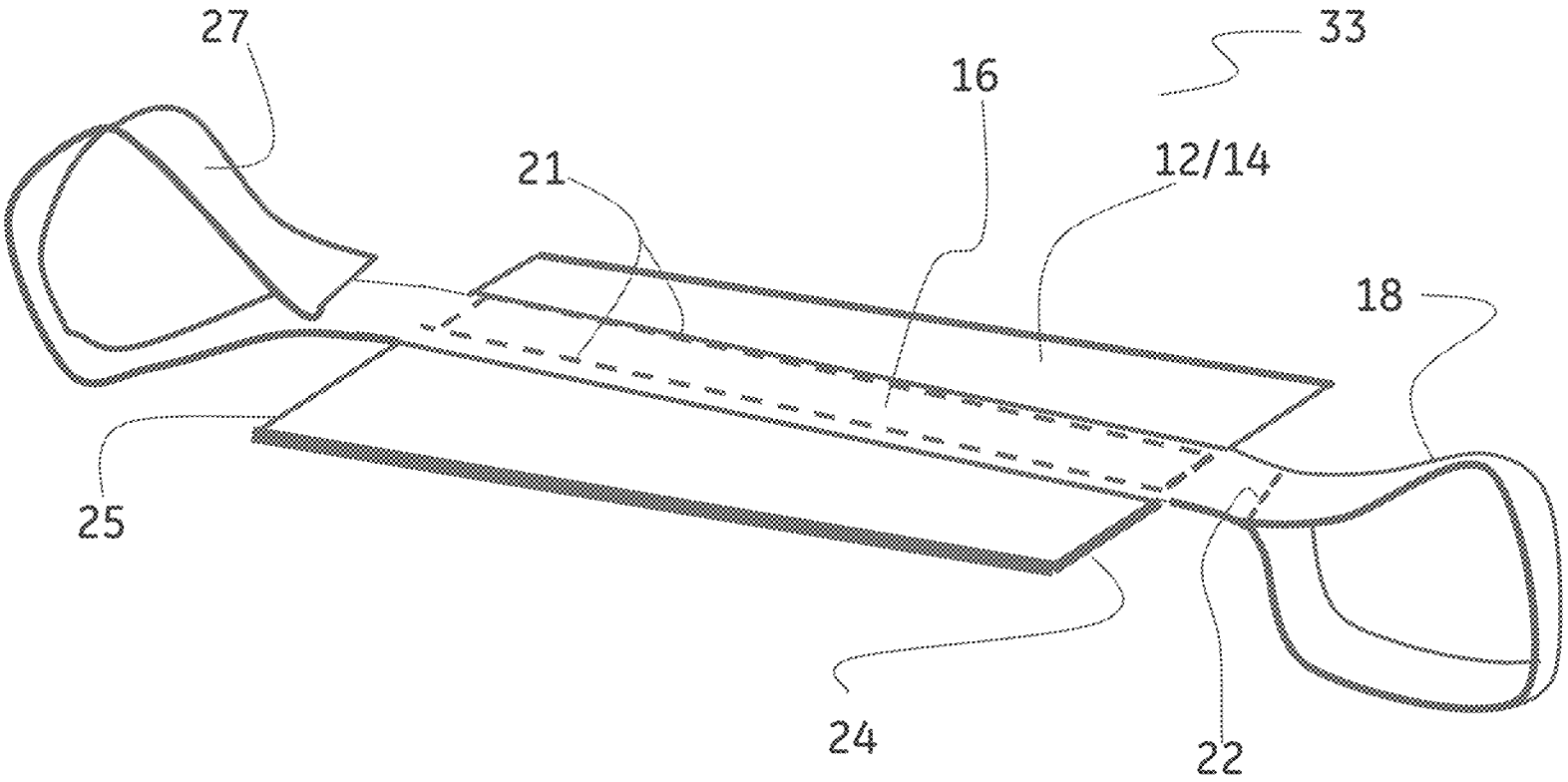
FIG. 7 illustrates a method of making an exercise accessory provided by the present invention.
Figure 8:
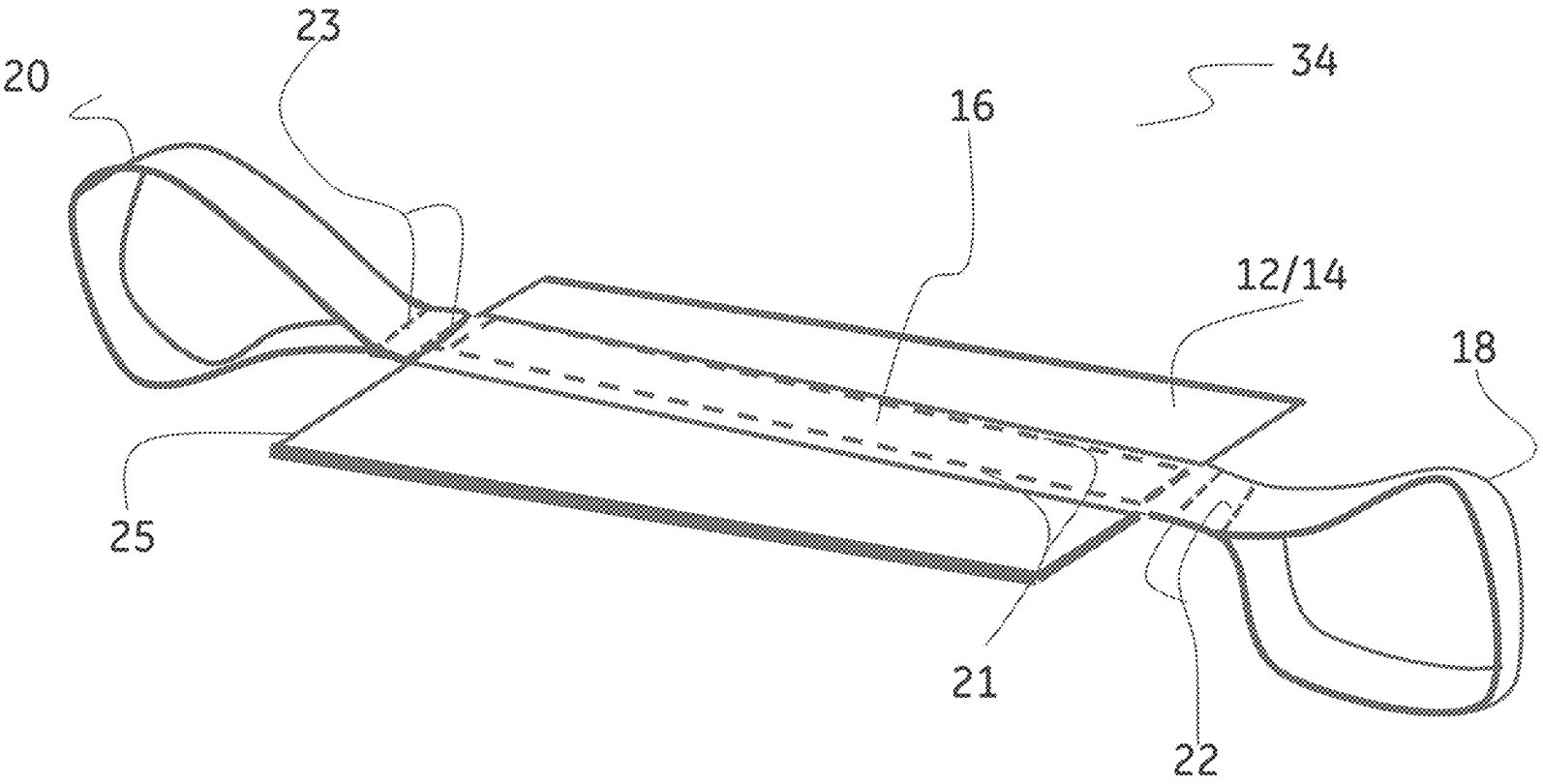
FIG. 8 illustrates a method of making an exercise accessory provided by the present invention.

Referring to FIG. 6, FIG. 7, and FIG. 8 the figures represents a second step 32, third step 33 and fourth step 34 respectively in the method of making an exercise accessory 30 begun in FIG. 5. In the second step (FIG. 6) the ends of the reinforcing member 16 are folded back upon themselves to form a first incipient loop 26 and a second incipient loop 27. In the third step 33 (FIG. 7) the first loop 18 defined by the reinforcing member is completed by joining a length of the reinforcing member 16 at the first opposing end 24 to itself with a second set of stiches 22. In the fourth step 34 the second loop 20 defined by the reinforcing member is completed by joining via third set of stitches 23 a length of the reinforcing member 16 at the second opposing end 25 to itself and completing the formation of the exercise accessory.

Figure 9:
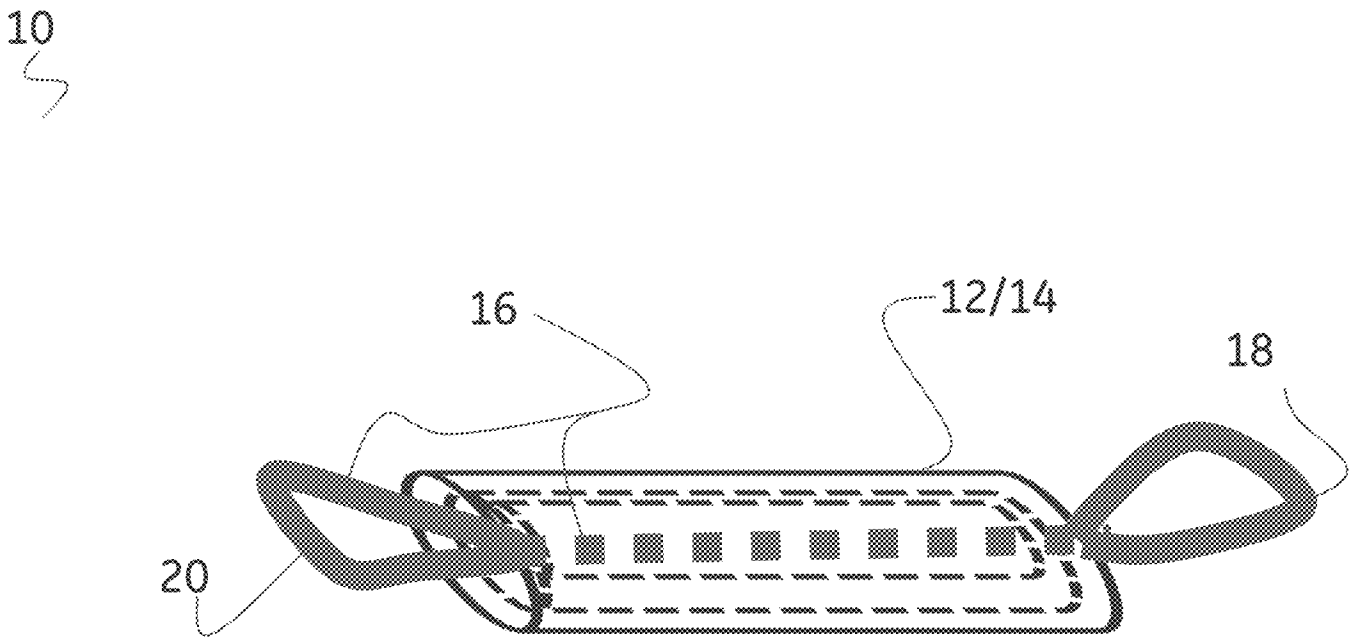
FIG. 9 illustrates an exercise accessory provided by the present invention.

Referring to FIG. 9, the figure represents the exercise accessory 10 completed in FIG. 8 after the moisture absorbent fabric 12 or moisture wicking fabric 14 has been wrapped around the central portion of the reinforcing member 16. In the embodiment shown, the reinforcing member is said to be partially enveloped by fabric 12/14 with the first and second loops 18 and 20 defined by the reinforcing member extending beyond first and second opposing ends of the moisture absorbent fabric.

Figure 10:
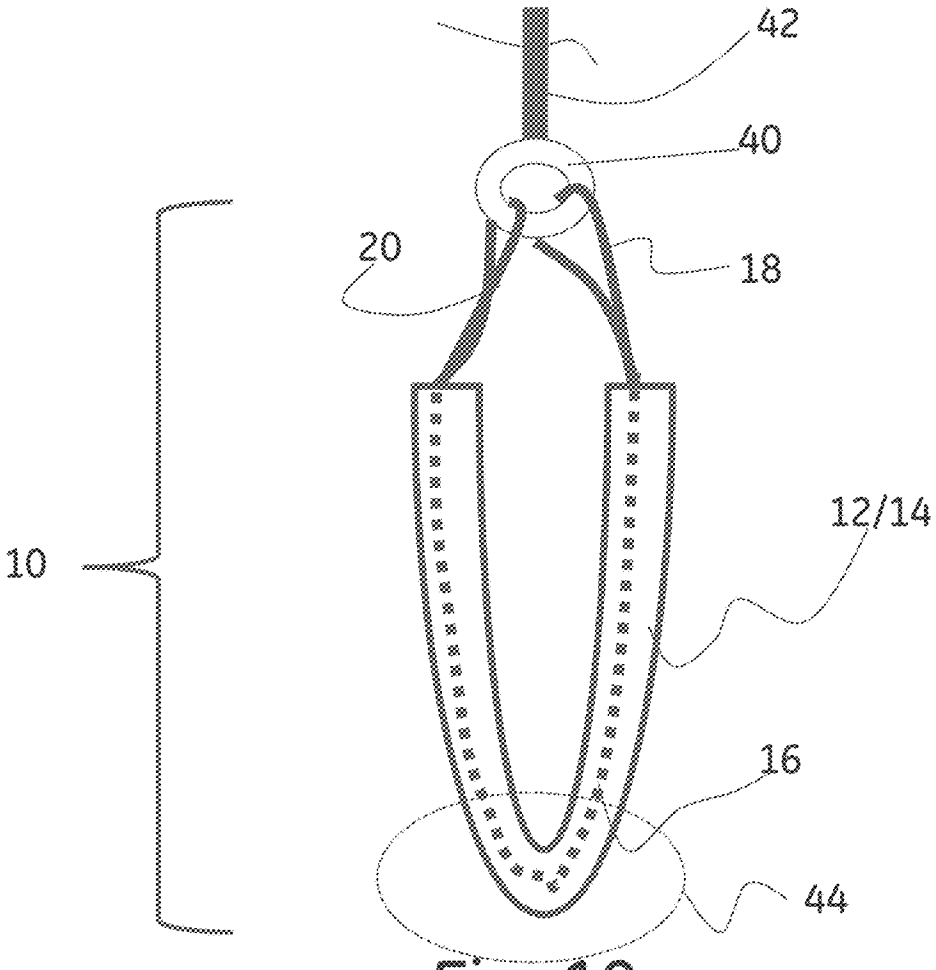
FIG. 10 illustrates an exercise accessory provided by the present invention.

Referring to FIG. 10, the figure represents an exercise accessory 10 shown in FIG. 9 and provided by the present invention, attached via the first and second loops to an exerciser (not shown) via an attachment accessory 40 and tether 42. The handgrip area 44 is indicated and may be gripped by an athlete using one or two hands.

Figure 11:
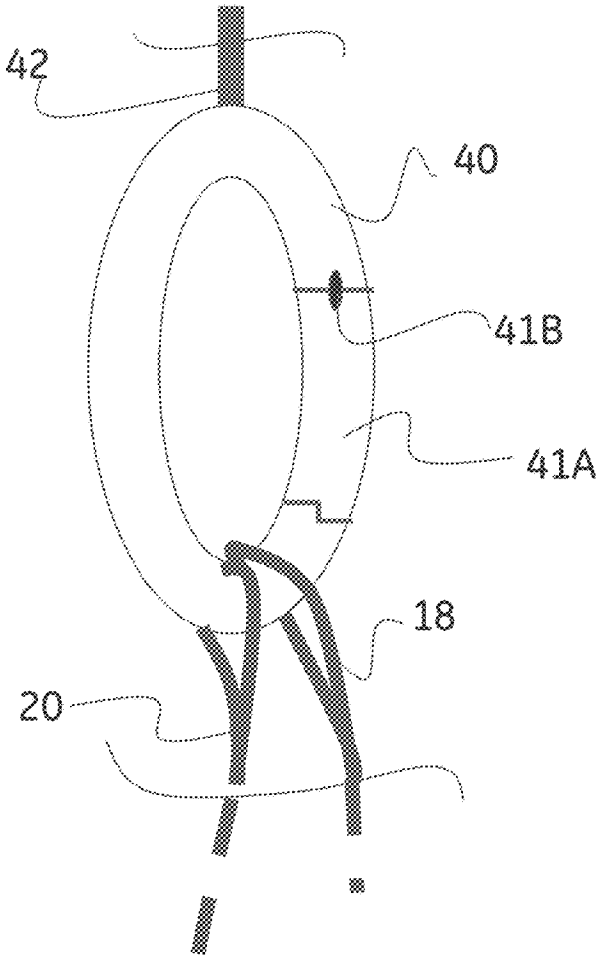
FIG. 11 illustrates an attachment accessory which may be used to connect an exercise accessory provided by the present invention to an exerciser.

Referring to FIG. 11, the figure represents an embodiment of the exercise accessory 10 shown in FIG. 10 in which the attachment accessory 40 is a carabiner comprising gate 41A and pin 41B components for ease of attachment to an exerciser.

Figure 12:
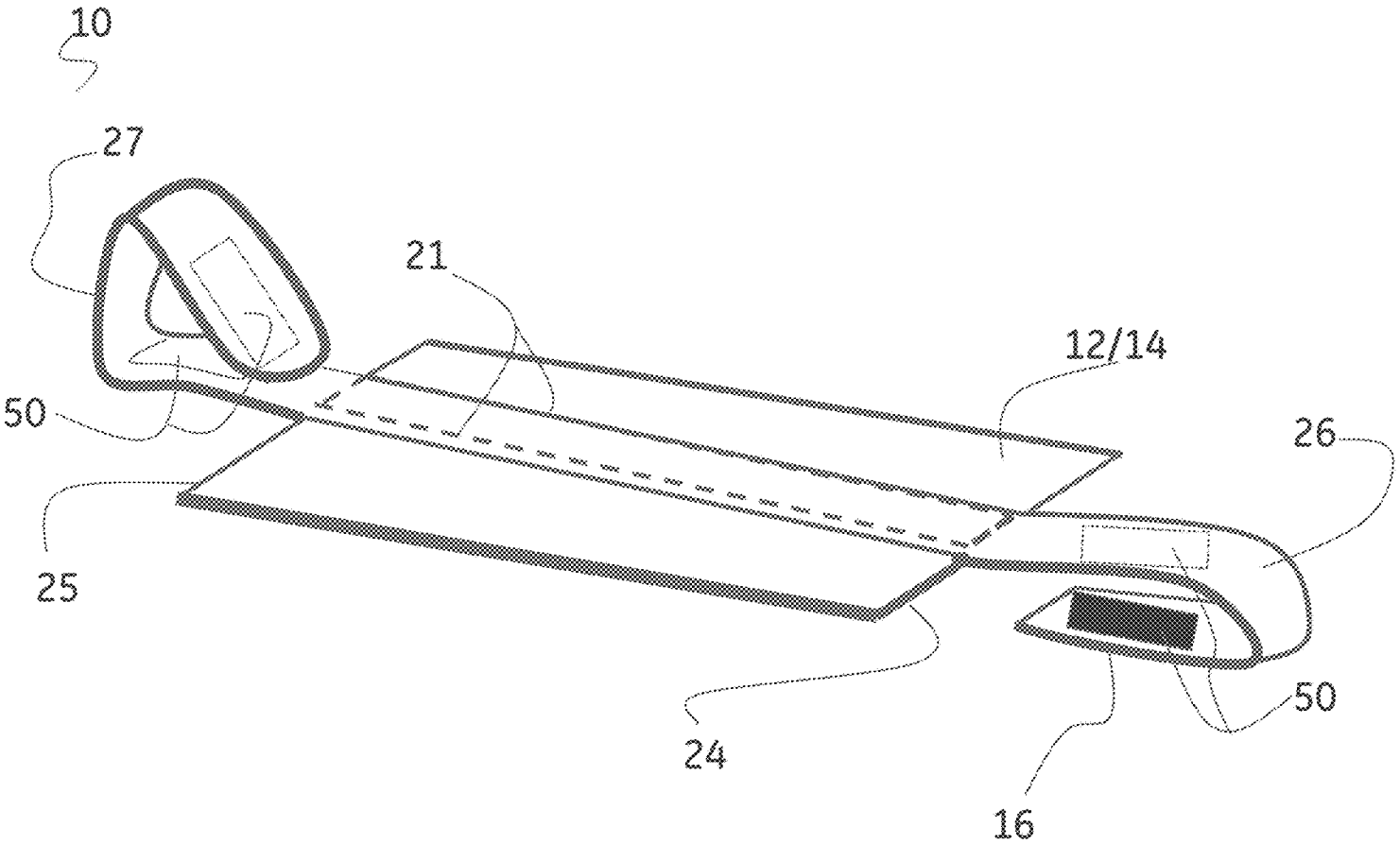
FIG. 12 illustrates an exercise accessory provided by the present invention.

Referring to FIG. 12, the figure represents an exercise accessory 10 provided by the present invention in which the loops 18 and 20 defined by the reinforcing member are reversibly coupled using a friction coupling 50, such as a hook and loop coupling, for example a Velcro coupling, a snap coupling, or a friction fastener such as are used in Smart Tie fasteners available from HCL Fasteners, Inc. In the embodiment shown, the first and second loops 18 and 20 of the reinforcing member 16 are formed by engaging the two components of the friction coupling, for example the complementary hook and loop strips of a Velcro friction coupling.

Figure 13:
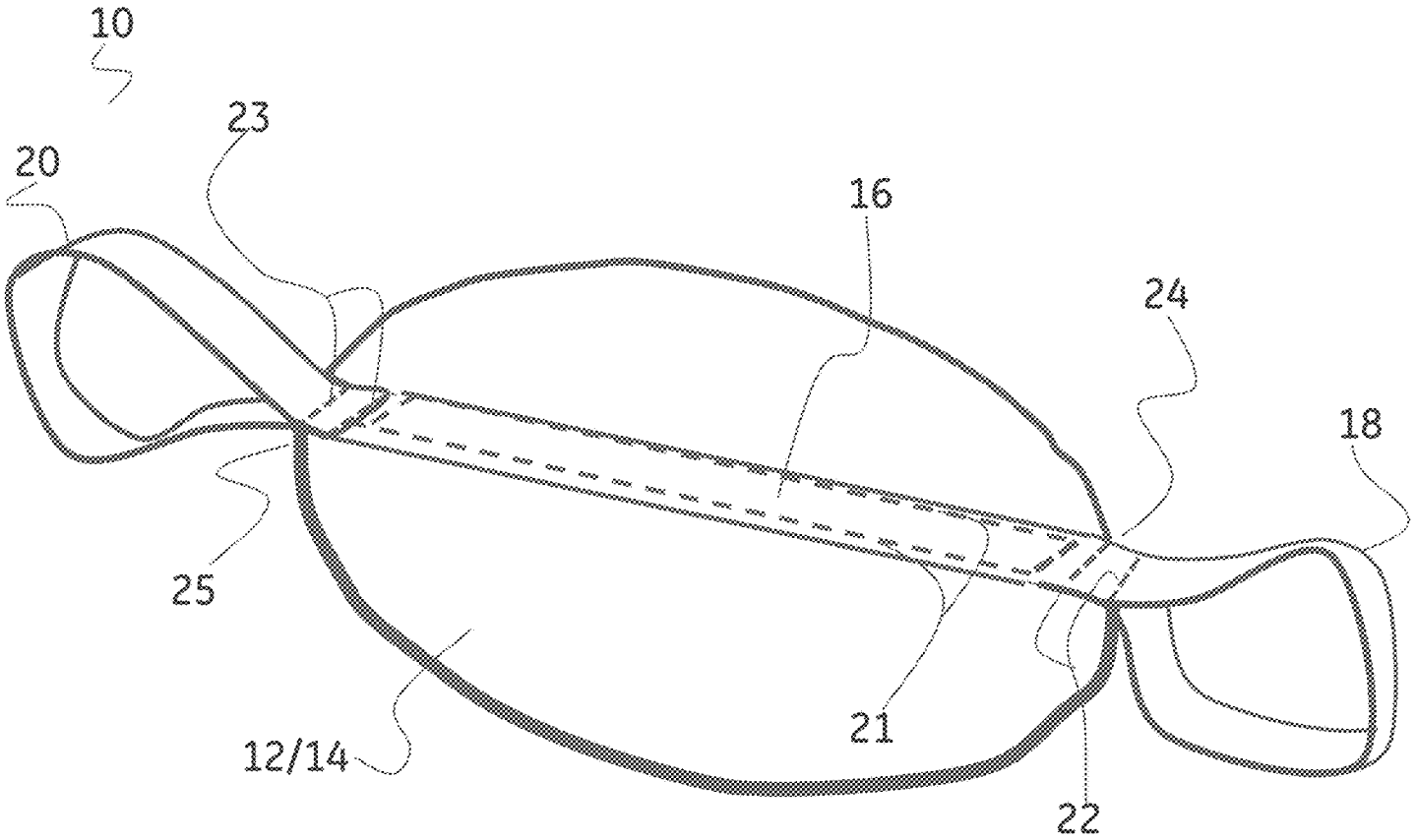
FIG. 13 illustrates an exercise accessory provided by the present invention.

Referring to FIG. 13, the figure represents an embodiment of an exercise accessory 10 provided by the present invention in which the fabric 12/14 is non-rectangular. The reinforcing member is joined to the fabric by a first set of stitches 21. First and second loops 18 and 20 are created from the ends of the reinforcing member 16 by folding the reinforcing member back upon itself and introducing the second 22 and third 23 sets of stitches shown.

Figure 14:
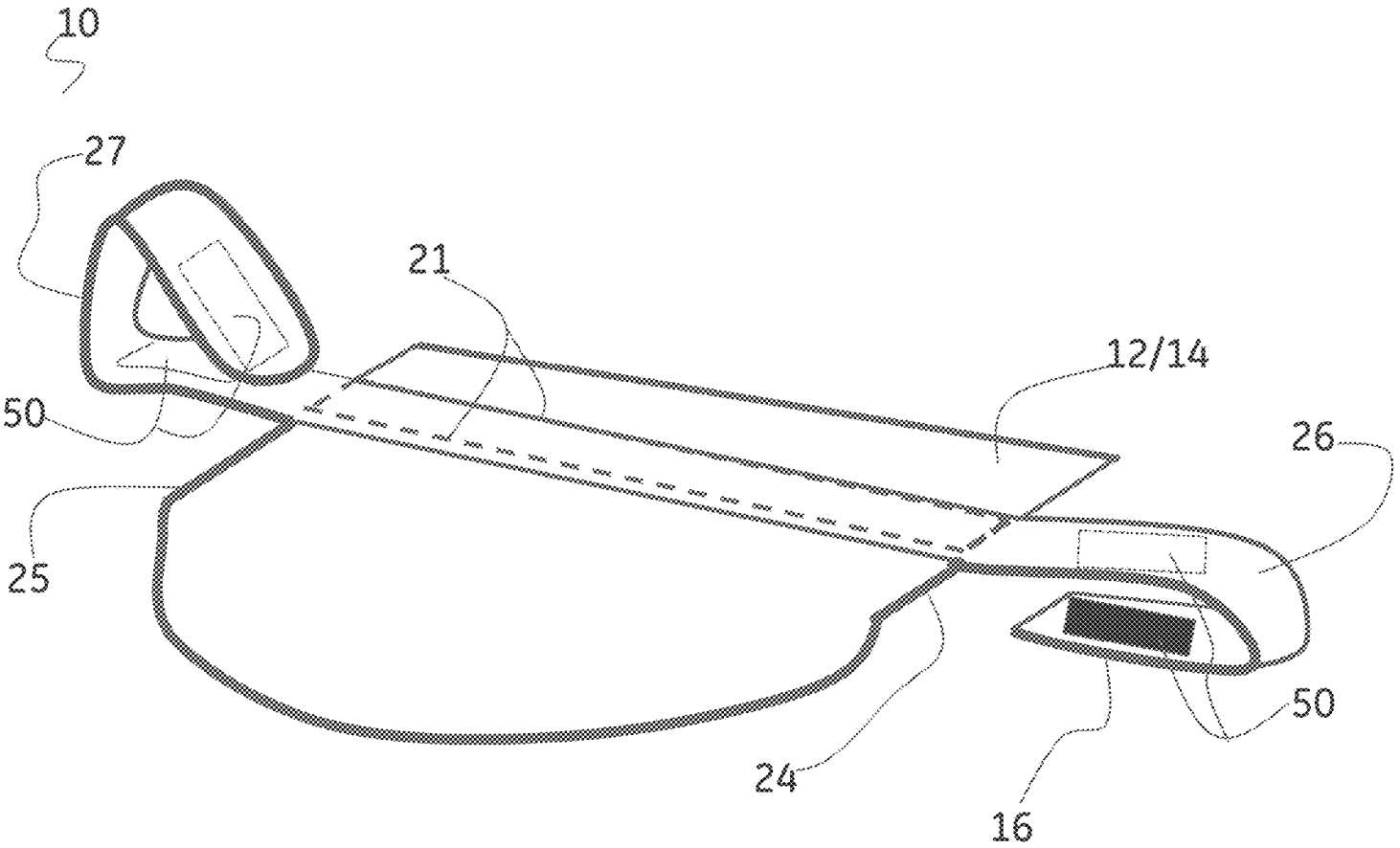
FIG. 14 illustrates an exercise accessory provided by the present invention.

Referring to FIG. 14, the figure represents an embodiment of an exercise accessory 10 provided by the present invention in which the fabric 12/14 is non-rectangular and loops 18 and 20 defined by the reinforcing member 16 comprise friction couplings 50. The reinforcing member is joined to the moisture absorbent or moisture wicking fabric 12/14 by a first set of stitches 21.

Figure 15:
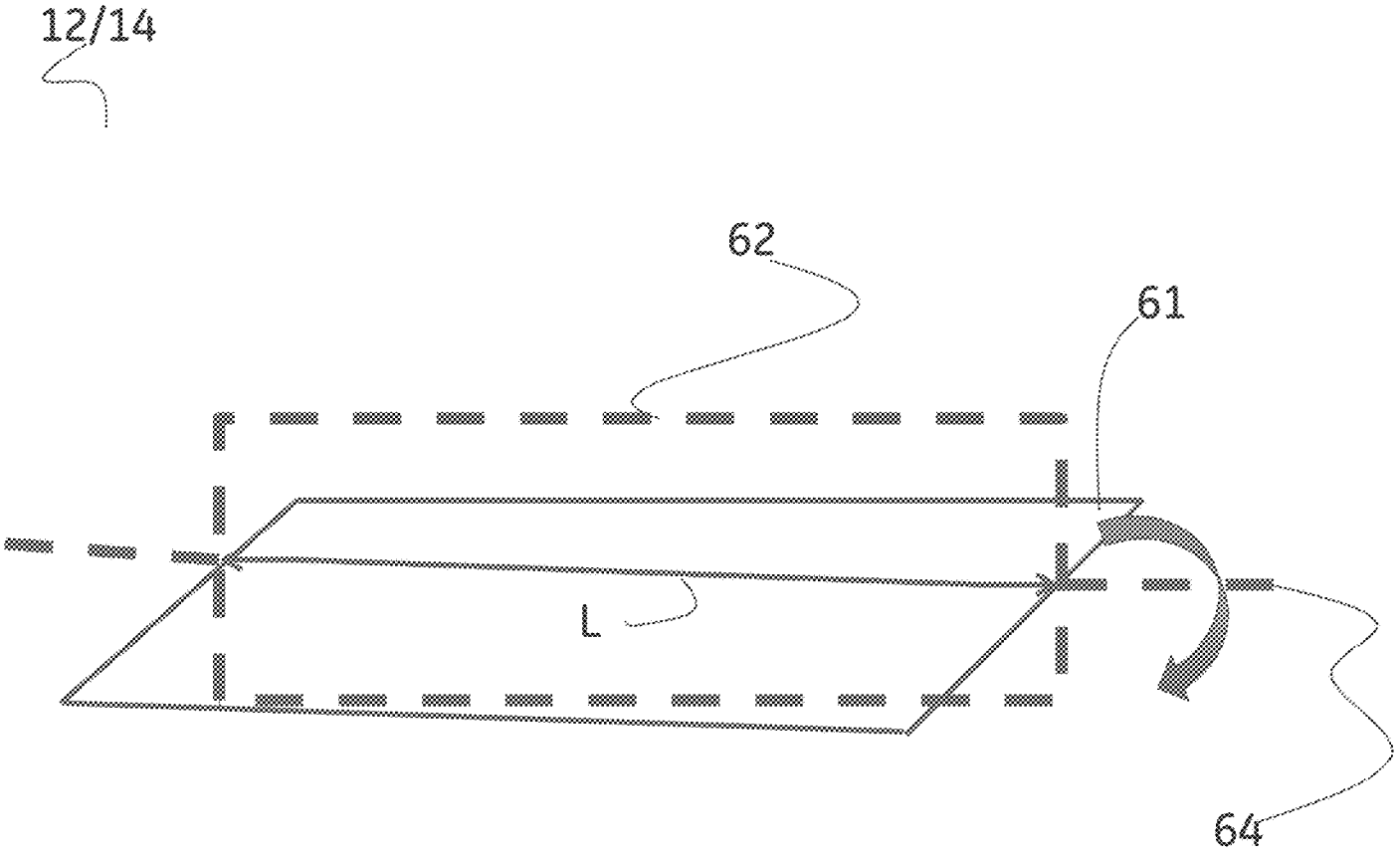
FIG. 15 illustrates a component of an exercise accessory provided by the present invention.

Referring to FIG. 15, the figure represents a moisture absorbent fabric 12 or moisture wicking fabric 14 (shown in a first rotary position 61 and a second rotary position 62) suitable for use according to one or more embodiments of the present invention wherein the length L of the fabric upon which the reinforcing member 16 is to be disposed corresponds to an idealized longitudinal rotational axis 64 of the fabric.

Figure 16:
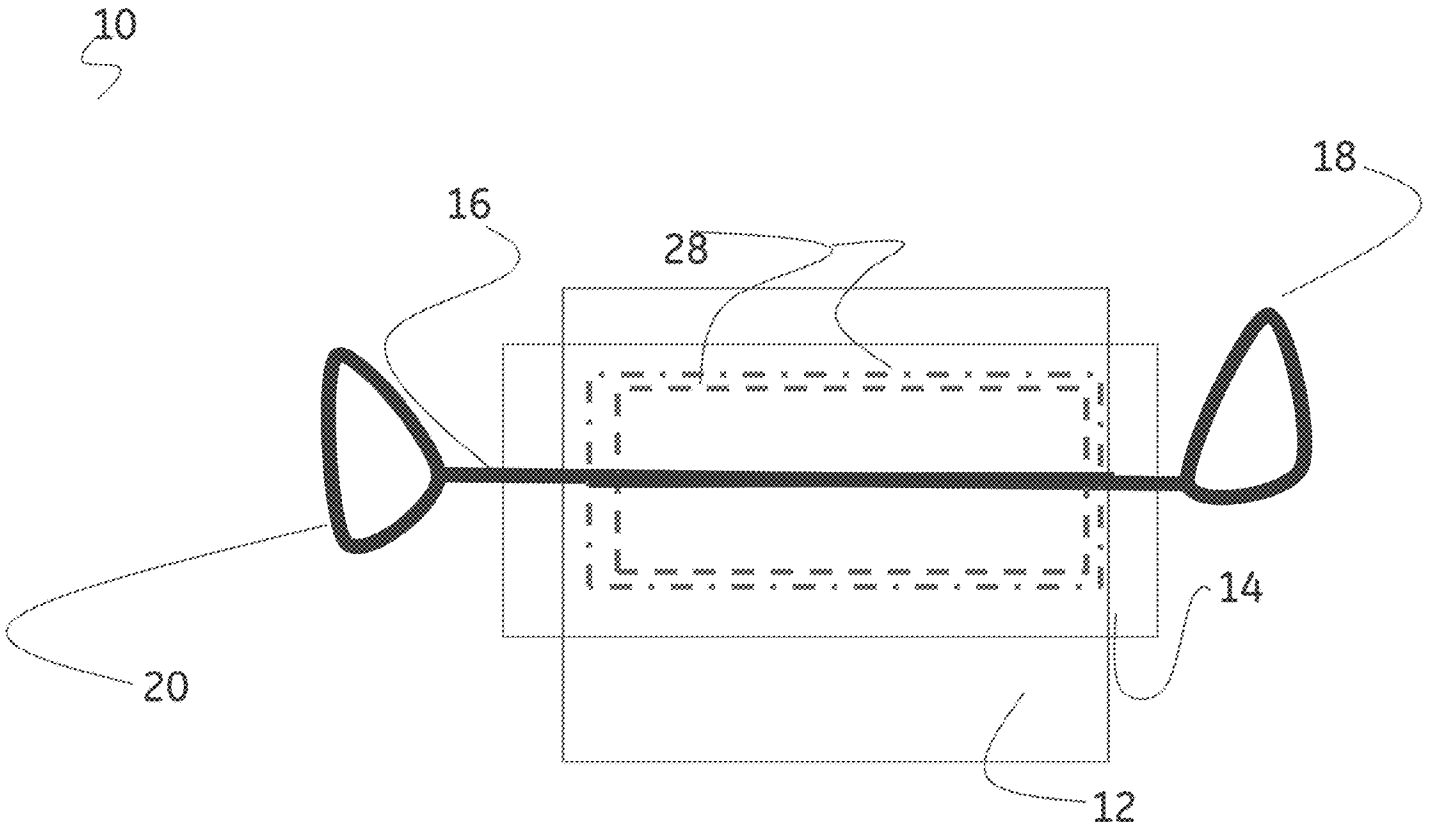
FIG. 16 illustrates an exercise accessory provided by the present invention.
Figure 17:
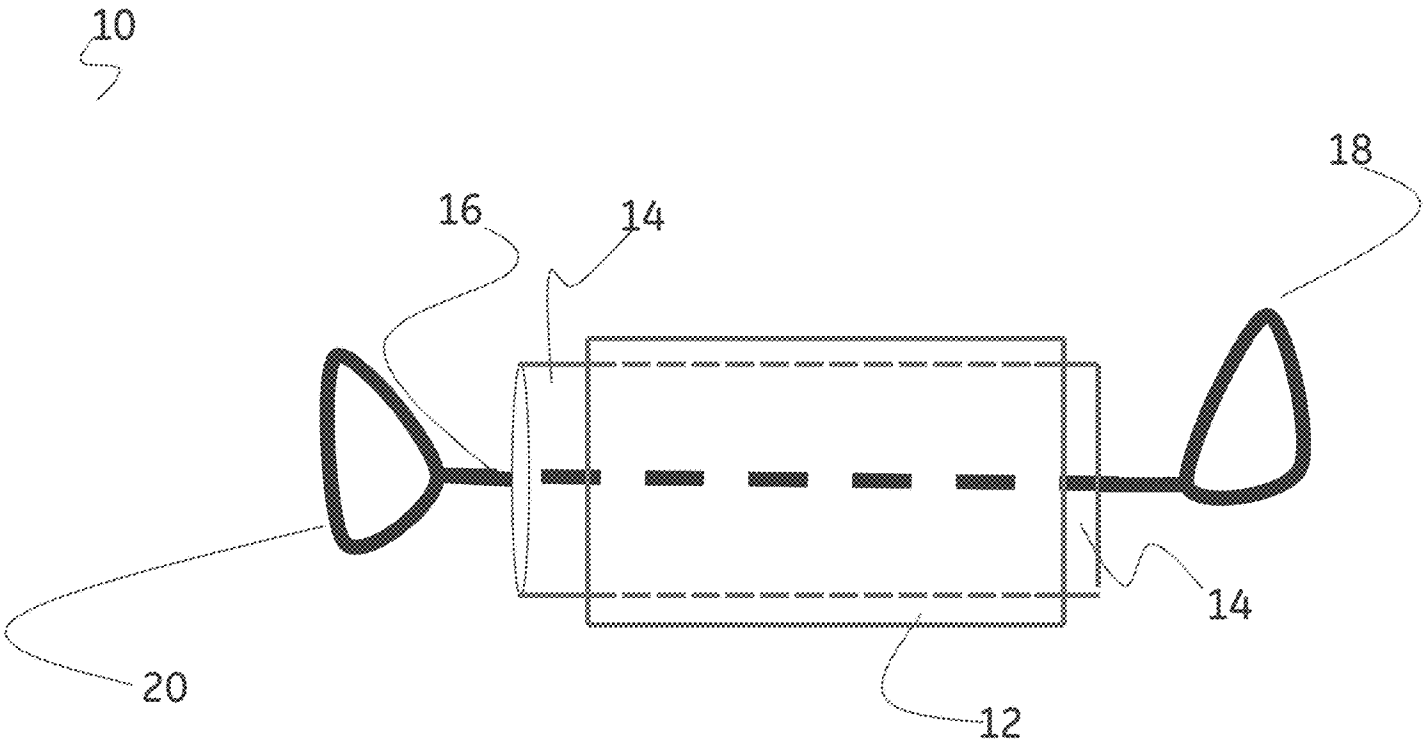
FIG. 17 illustrates an exercise accessory provided by the present invention.

Referring to FIG. 16, the figure represents an exercise accessory 10 provided by the present invention comprising both a moisture absorbent fabric 12 and a moisture wicking fabric 14. In the embodiment shown, the moisture wicking fabric 14 is shown as disposed atop and longer than moisture absorbent fabric 12. The moisture wicking fabric and moisture absorbent fabric are joined to one another by a double set of stitches 28. While the moisture wicking fabric has the greater length, the moisture absorbent fabric has the greater width as between the two fabrics. The reinforcing member 16 may be joined to both the moisture wicking fabric and the moisture absorbent fabric via one or more of stitches, staples, clamps, adhesives, friction couplings, and combinations of the foregoing (not shown in FIG. 16), or to the moisture wicking fabric only. Both the moisture wicking fabric and the moisture absorbent fabric are configured to partially envelop the reinforcing member as shown in FIG. 17 which shows the exercise accessory 10 in which the moisture wicking fabric 14 and moisture absorbent fabric 12 have been wrapped about the reinforcing member 16. A salutary feature of the embodiment illustrated in FIG. 17 is that during use, the athlete's hand contacts the moisture absorbent fabric 12, for example terry cloth. Moisture is transferred from hand to the moisture absorbent fabric and from moisture absorbent fabric to the moisture wicking fabric 14 which extends beyond the opposing ends of the moisture absorbent fabric and is in direct contact with the air and hence may effectively and comfortably transfer moisture from the athlete's hand (or hands) to the atmosphere, thereby reducing the overall wetness of the exercise accessory over the course of an exercise routine.

EXPERIMENTAL SECTION

Comparative Example #1

A rectangular cotton hand towel having dimensions 16×30 inches was fitted at the middle of each opposing end with a ½ inch brass grommet (available from Home Depot, part number 81264) about one inch from the edge of the towel. The grommets were located approximately along the longitudinal centerline axis of the hand towel. In various tests using this hand towel or an analogously prepared hand towel, it was noted that the grommet to towel connection invariably failed when the grommet was linked to a fixture using a carabiner as an attachment accessory and a moderate level of stress was applied to the center of the towel by the hand of a 24-year-old, 180-pound athlete. Although various efforts were made to better secure the grommet to the towel, this connection could not be made sufficiently strong to withstand the stress of a typical workout routine.

Example 1

In order to better understand this example of the exercise accessory provided by the present invention, useful reference may be made to FIGS. 5-8. A one (1) inch wide nylon strap having a length of about forty-two (42) inches was arrayed along the longitudinal axis of a rectangular cotton hand towel having dimensions 16×30 inches, the nylon strap being arrayed such that approximately six (6) inches of nylon strap extended beyond the first and second opposing ends of the fabric. The nylon strap was then secured to the towel by sewing it to the towel using a rectangular array of stiches illustrated in FIGS. 5 and 6 herein. All stiches were made using heavy duty nylon thread. The excess nylon strap overhanging the first opposing end of the towel was then folded upon itself to create an incipient loop which was secured to itself with a second set of stiches to create a first three-inch loop. A second loop was created analogously at the second opposing end to provide the completed exercise accessory. Box stiches were employed in the creation of the first and second loops.

Example 2

A one (1) inch wide heavy nylon strap having a length of about forty-two and one half (42.5) inches was arrayed along the longitudinal axis of a rectangular cotton hand towel having dimensions 16×30, the nylon strap being arrayed such that approximately six inches of nylon strap extended beyond the first and second opposing ends of the fabric. The nylon strap was then secured to the towel by sewing it to the towel using a rectangular array of stiches illustrated in FIGS. 5 and 6 herein. All stiches were made using heavy duty nylon thread. The excess nylon strap overhanging the first opposing end of the towel was then folded upon itself to create an incipient loop which was secured to itself and the fabric with a second set of stiches to create a first loop measuring about 3 inches. A second loop was created analogously at the second opposing end to provide the completed exercise accessory. Box stiches were employed in the creation of the first and second loops.

The foregoing examples are merely illustrative, serving to illustrate only some of the features of the invention. The appended claims are intended to claim the invention as broadly as it has been conceived and the examples herein presented are illustrative of selected embodiments from a manifold of all possible embodiments. Accordingly, it is Applicants' intention that the appended claims are not to be limited by the choice of examples utilized to illustrate features of the present invention. As used in the claims, the word "comprises" and its grammatical variants logically also subtend and include phrases of varying and differing extent such as for example, but not limited thereto, "consisting essentially of" and "consisting of" Where necessary, ranges have been supplied, those ranges are inclusive of all sub-ranges there between. It is to be expected that variations in these ranges will suggest themselves to a practitioner having ordinary skill in the art and where not already dedicated to the public, those variations should where possible be construed to be covered by the appended claims. It is also anticipated that advances in science and technology will make equivalents and substitutions possible that are not now contemplated by reason of the imprecision of language and these variations should also be construed where possible to be covered by the appended claims.

What is claimed is:

1. An exercise accessory comprising: (a) a moisture absorbent or moisture wicking fabric having opposing ends; and (b) a reinforcing strap arrayed along a length of the fabric and coupled to the fabric with stitching; wherein the moisture absorbent or moisture wicking fabric is configured to envelop at least a portion of the reinforcing strap, and wherein the reinforcing strap defines one or more loops configured to be operably coupled to an exerciser via an attachment accessory.

2. The exercise accessory according to claim 1, comprising a moisture absorbent fabric comprising a moisture absorbent material selected from the group consisting of cotton, linen, and combinations thereof.

3. The exercise accessory according to claim 1, wherein the fabric is configured as a towel having a rectangular shape.

4. The exercise accessory according to claim 1, wherein the reinforcing strap comprises one or more of a polymeric material, a composite material, a metal, a metal alloy, and combinations of two or more of the foregoing.

5. The exercise accessory according to claim 1, wherein the reinforcing strap comprises a polymeric material selected from the group consisting of polyamides.

6. The exercise accessory according to claim 1, wherein the reinforcing strap comprises nylon.

7. The exercise accessory according to claim 1, wherein the length of the fabric corresponds to a longitudinal axis of the fabric.

8. The exercise accessory according to claim 1, wherein the reinforcing strap is further coupled to the fabric with one or more staples, clamps, adhesives, friction couplings, and combinations of the foregoing.

9. The exercise accessory according to claim 1, wherein the reinforcing strap is coupled to the fabric with stitching comprising a polyester fiber.

10. The exercise accessory according to claim 1, wherein the reinforcing strap is coupled to the fabric with stitching comprising a nylon fiber.

11. The exercise accessory according to claim 1, wherein the reinforcing strap defines two and only two loops.

12. The exercise accessory according to claim 1, wherein the exerciser is a resistance training apparatus.

13. The exercise accessory according to claim 1, wherein the attachment accessory is a carabiner.

14. An exercise accessory comprising: (a) a terry-cloth fabric configured as a towel having opposing ends; and (b) a nylon reinforcing strap arrayed along a longitudinal axis of the fabric and coupled to the fabric with nylon stitches; wherein the fabric is configured to substantially envelop the reinforcing strap arrayed along the longitudinal axis of the fabric, and wherein the reinforcing strap defines two loops configured to be operably coupled to an exerciser via an attachment accessory.

* * * * *